US009803496B2

(12) United States Patent
Lutjen et al.

(10) Patent No.: US 9,803,496 B2
(45) Date of Patent: Oct. 31, 2017

(54) BREAK-IN SYSTEM FOR GAPPING AND LEAKAGE CONTROL

(71) Applicant: United Technologies Corporation, Hartford, CT (US)

(72) Inventors: Paul M. Lutjen, Kennebunkport, ME (US); Richard K. Hayford, Cape Neddick, ME (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 336 days.

(21) Appl. No.: 14/789,740

(22) Filed: Jul. 1, 2015

(65) Prior Publication Data

US 2017/0002677 A1 Jan. 5, 2017

(51) Int. Cl.

| | |
|---|---|
| ***F01D 11/12*** | (2006.01) |
| ***F01D 11/00*** | (2006.01) |
| ***F01D 25/24*** | (2006.01) |

(52) U.S. Cl.

CPC ..... *F01D 11/122* (2013.01); *F01D 11/005* (2013.01); *F01D 11/006* (2013.01); *F01D 25/246* (2013.01)

(58) Field of Classification Search

CPC ..... F01D 11/00; F01D 11/005; F01D 11/006; F01D 11/02; F01D 11/122; F01D 25/246; F16J 15/02; F16J 15/144

See application file for complete search history.

(56) References Cited

U.S. PATENT DOCUMENTS

| | | | | |
|---|---|---|---|---|
| 3,262,635 | A * | 7/1966 | Smuland | F01D 11/02 277/414 |
| 5,609,469 | A | 3/1997 | Worley et al. | |
| 5,785,492 | A * | 7/1998 | Belsom | F01D 25/246 415/173.1 |
| 9,068,469 | B2 * | 6/2015 | Tucker | F01D 11/006 |
| 2008/0061515 | A1 | 3/2008 | Durocher et al. | |
| 2013/0058768 | A1 | 3/2013 | Tucker et al. | |
| 2013/0177400 | A1 * | 7/2013 | Ring | F01D 9/042 415/119 |

FOREIGN PATENT DOCUMENTS

| | | | |
|---|---|---|---|
| WO | 2014105800 | 7/2014 | |
| WO | WO 2014105800 A1 * | 7/2014 | F02C 7/28 |

OTHER PUBLICATIONS

Extended European Search Report dated Nov. 4, 2016 in European Application No. 16177493.0.

* cited by examiner

*Primary Examiner* — Ninh H Nguyen
*Assistant Examiner* — Brian P Wolcott
(74) *Attorney, Agent, or Firm* — Snell & Wilmer L.L.P.

(57) ABSTRACT

A blade outer air seal for use in a gas turbine engine having an axis of rotation includes a main body having a mating face configured to face, be positioned radially outward from, and be positioned adjacent to a rotor blade of the gas turbine engine. The blade outer air seal also includes an axial member extending aft from the main body, having a first radial face configured to face a second radial face of an outer diameter platform of a stator of the gas turbine engine, and having a first abradable material coupled to the first radial face.

16 Claims, 4 Drawing Sheets

BREAK-IN SYSTEM FOR GAPPING AND LEAKAGE CONTROL

FIELD

The present disclosure relates generally to seals within a gas turbine engine and, more particularly, to a seal between a blade outer air seal and an outer diameter platform of a turbine section or a compressor section.

BACKGROUND

Gas turbine engines typically include a fan section, a compressor section, a combustor section and a turbine section. The turbine section may include multiple stages of rotors that rotate about an axis in response to receiving a flow of air and stators that do not rotate relative to the axis. In order to prevent the air from leaking past the rotors, a blade outer air seal is positioned radially outward from the rotors and forms a seal with the rotors. The outer diameter edges of the vanes are coupled to an outer diameter platform. It is desirable to prevent air from leaking between the blade outer air seal and the outer diameter platform.

SUMMARY

What is described is a blade outer air seal for use in a gas turbine engine having an axis of rotation. The blade outer air seal includes a main body having a mating face configured to face, be positioned radially outward from, and be positioned adjacent to a rotor blade of the gas turbine engine. The blade outer air seal also includes an axial member extending aft from the main body, having a first radial face configured to face a second radial face of an outer diameter platform of a stator of the gas turbine engine, and having a first abradable material coupled to the first radial face.

What is described is a first static component for use in a gas turbine engine having an axis of rotation. The first static component includes a main body and an axial member extending aft from the main body. The axial member has a first radial face configured to face a second radial face of a second static component of the gas turbine engine, and a first abradable material coupled to the first radial face.

In any of the foregoing static components, the first abradable material is configured to form a flow restriction with an abrasive material coupled to the second radial face of the second static component.

In any of the foregoing static components, the first abradable material is configured to be axially aligned with the abrasive material for a distance in an axial direction that is sufficiently large to ensure that the flow restriction continues to restrict a flow under standard operating conditions of the gas turbine engine.

In any of the foregoing static components, the flow restriction is configured to supplement a sheet metal gasket bellows seal positioned upstream from the flow restriction.

In any of the foregoing static components, the first static component is a blade outer air seal and the second static component is an outer diameter platform.

In any of the foregoing static components, the main body includes a second abradable material coupled to a mating face and wherein the first abradable material has the same composition as the second abradable material.

In any of the foregoing static components, the first radial face is positioned radially outward from and at least partially faces the second radial face.

Also described is a system for reducing leakage air in a gas turbine engine having an axis of rotation. The system includes a blade outer air seal having a main body and an axial member extending away from the main body. The axial member has a first radial face and one of a first abradable material or an abrasive material coupled to the first radial face. The system also includes an outer diameter platform having a second radial face at least partially facing the first radial face and the other of the first abradable material or the abrasive material coupled to the second radial face such that the first abradable material and the abrasive material form a flow restriction.

Any of the foregoing systems may further include a sheet metal gasket bellows seal positioned downstream from the flow restriction.

Any of the foregoing systems may further include a rotor blade and wherein the blade outer air seal further includes a mating face positioned radially outward from the rotor blade and a second abradable material coupled to the mating face and configured to form a seal with the rotor blade and wherein the first abradable material has the same composition as the second abradable material.

In any of the foregoing systems, the abrasive material includes cubic boron nitride.

In any of the foregoing systems, the first radial face of the blade outer air seal is positioned radially outward from and at least partially faces the second radial face of the outer diameter platform.

In any of the foregoing systems, the system is implemented in a high pressure turbine section of the gas turbine engine.

In any of the foregoing systems, the first abradable material is configured to be axially aligned with the abrasive material for a distance in an axial direction that is sufficiently large to ensure that the flow restriction continues to restrict a flow under standard operating conditions of the gas turbine engine.

Also described is a gas turbine engine. The gas turbine engine includes a compressor section, a combustor section, and a turbine section. At least one of the compressor section or the turbine section include a rotor blade and a stator. The turbine section also includes a blade outer air seal positioned radially outward from the rotor blade and having a main body and an axial member extending away from the main body, the axial member having a first radial face and a first abradable material coupled to the first radial face. The turbine section also includes an outer diameter platform positioned radially outward from the stator and having a second radial face at least partially facing the first radial face and an abrasive material coupled to the second radial face such that the first abradable material and the abrasive material form a flow restriction.

Any of the foregoing gas turbine engines may include, a sheet metal gasket bellows seal positioned upstream from the flow restriction.

In any of the foregoing gas turbine engines, the blade outer air seal further includes a mating face positioned radially outward from the rotor blade and a second abradable material coupled to the mating face and configured to form a seal with the rotor blade.

In any of the foregoing gas turbine engines, the first abradable material has the same composition as the second abradable material.

In any of the foregoing gas turbine engines, the first radial face is positioned radially outward from and at least partially faces the second radial face.

In any of the foregoing gas turbine engines, the first abradable material is configured to be axially aligned with the abrasive material for a distance in an axial direction that is sufficiently large to ensure that the flow restriction continues to restrict a flow under standard operating conditions of the gas turbine engine.

The foregoing features and elements are to be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, is best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Figure 1:
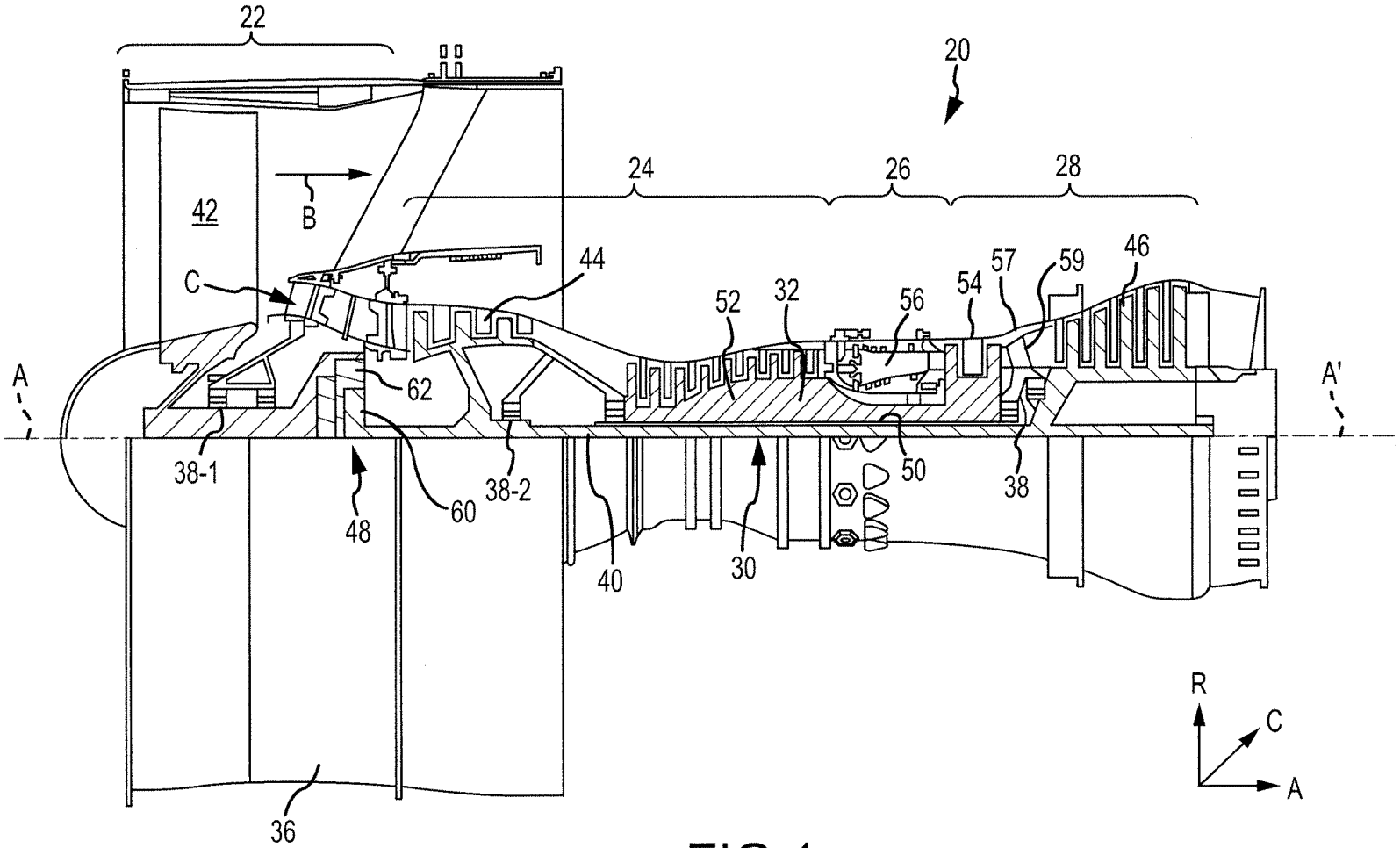
FIG. 1 is a cross-sectional view of an exemplary gas turbine engine, in accordance with various embodiments.

With reference to FIG. 1, a gas turbine engine 20 is provided. An A-R-C axis illustrated in each of the figures illustrates the axial (A), radial (R) and circumferential (C) directions. As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion. As utilized herein, radially inward refers to the lower R direction (such that 0 is the radially innermost value) and radially outward refers to the increasing R direction.

Gas turbine engine 20 may be a two-spool turbofan that generally incorporates a fan section 22, a compressor section 24, a combustor section 26 and a turbine section 28. Alternative engines include an augmentor section among other systems or features. In operation, fan section 22 drives air along a bypass flow-path B while compressor section 24 drives air along a core flow-path C for compression and communication into combustor section 26 then expansion through turbine section 28. Although depicted as a turbofan gas turbine engine 20 herein, it should be understood that the concepts described herein are not limited to use with turbofans as the teachings may be applied to other types of turbine engines including three-spool architectures.

Gas turbine engine 20 generally comprise a low speed spool 30 and a high speed spool 32 mounted for rotation about an engine central longitudinal axis A-A' relative to an engine static structure 36 via several bearing systems 38, 38-1, and 38-2. It should be understood that various bearing systems 38 at various locations may alternatively or additionally be provided, including for example, bearing system 38, bearing system 38-1, and bearing system 38-2.

Low speed spool 30 generally includes an inner shaft 40 that interconnects a fan 42, a low pressure (or first) compressor section 44 and a low pressure (or first) turbine section 46. Inner shaft 40 is connected to fan 42 through a geared architecture 48 that can drive fan 42 at a lower speed than low speed spool 30. Geared architecture 48 includes a gear assembly 60 enclosed within a gear housing 62. Gear assembly 60 couples inner shaft 40 to a rotating fan structure. High speed spool 32 includes an outer shaft 50 that interconnects a high pressure (or second) compressor section 52 and high pressure (or second) turbine section 54. A combustor 56 is located between high pressure compressor 52 and high pressure turbine section 54. A mid-turbine frame 57 of engine static structure 36 is located generally between high pressure turbine 54 and low pressure turbine 46. Mid-turbine frame 57 supports one or more bearing systems 38 in turbine section 28. Inner shaft 40 and outer shaft 50 are concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C is compressed by low pressure compressor section 44 then high pressure compressor 52, mixed and burned with fuel in combustor 56, then expanded over high pressure turbine 54 and low pressure turbine 46. Mid-turbine frame 57 includes airfoils 59 which are in the core airflow path. Turbines 46, 54 rotationally drive the respective low speed spool 30 and high speed spool 32 in response to the expansion.

Gas turbine engine 20 is a high-bypass ratio geared aircraft engine. The bypass ratio of gas turbine engine 20 may be greater than about six (6). The bypass ratio of gas turbine engine 20 may also be greater than ten (10:1). Geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). The diameter of fan 42 may be significantly larger than that of the low pressure compressor section 44, and the low pressure turbine 46 may have a pressure ratio that is greater than about five (5:1). The pressure ratio of low pressure turbine 46 is measured prior to inlet of low pressure turbine 46 as related to the pressure at the outlet of low pressure turbine 46. It should be understood, however, that the above parameters are exemplary of various embodiments of a suitable geared architecture engine and that the present disclosure contemplates other turbine engines including direct drive turbofans.

The next generation turbofan engines are designed for higher efficiency and use higher pressure ratios and higher temperatures in high pressure compressor 52 than are conventionally experienced. These higher operating temperatures and pressure ratios create operating environments that cause thermal loads that are higher than the thermal loads conventionally experienced, which may shorten the operational life of current components.

Figure 2:
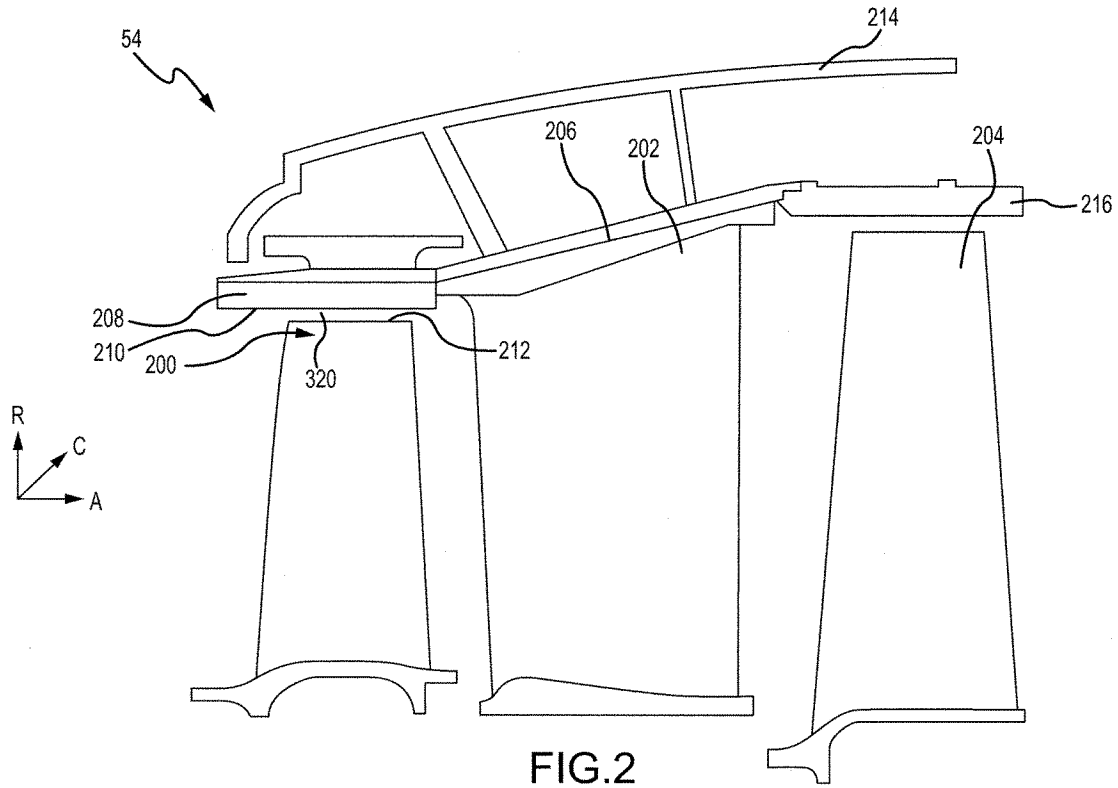
FIG. 2 is a cross-sectional view of a high pressure turbine section of the gas turbine engine of FIG. 1, in accordance with various embodiments.

With reference now to FIGS. 1 and 2, a portion of high pressure turbine section 54 includes a first rotor blade 200, a vane 202, and a second rotor blade 204. First rotor blade 200 and second rotor blade 204 are each configured to rotate about axis A-A' relative to vane 202 in response to receiving a flow of fluid from combustor section 26. Thus, power from the flow is converted to mechanical power by first rotor blade 200 and second rotor blade 204. Vane 202 is coupled to a frame 214 of high pressure turbine 54 and conditions the flow of air between first rotor blade 200 and second rotor blade 204. Vane 202 is thus a stator and does not rotate relative to axis A-A'.

It is desirable to prevent air leakage between each stage of high pressure turbine 54. Pressurized air is commonly diverted from combustor section 26 and/or compressor section 24 and is used to cool components within the turbine section 28. The diversion of flow for cooling components of turbine section 28 is parasitic to engine performance. Thus, well-sealed gaps between components along the axial direction (i.e., along the A axis), such as between a blade outer air seal (BOAS, also referred to as an "outer duct") 208 and an outer diameter platform 206, allow isolation of frame 214 from hot gaspath air and reduce negative performance impacts (such as efficiency).

Figure 3:
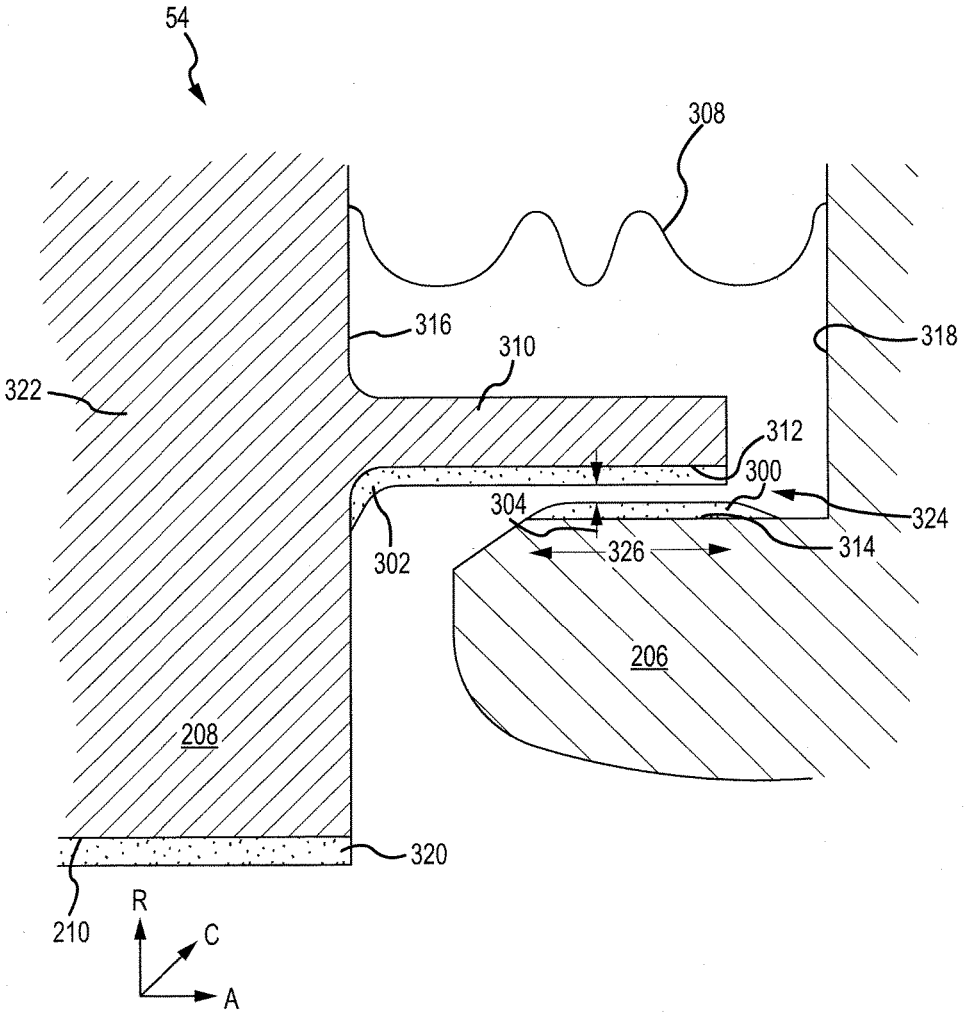
FIG. 3 is an enlarged view of a portion of the high pressure turbine section of FIG. 2, in accordance with various embodiments.

With reference to FIGS. 2 and 3, hot gas flowing between a blade tip of first rotor blade 200 and a radially inner surface of BOAS 208 (in FIG. 2, a mating face 210) reduces engine efficiency. Therefore, it is common that first rotor blade 200 may have an abrasive coating 212 on its tip and BOAS 208 may include a second abradable material 320 that is coupled to a mating face 210 of BOAS 208. The addition of second abradable material 320 to BOAS 208 reduces the radius of the hot gas flowpath. Accordingly, in response to rotation of first rotor blade 200, abrasive coating 212 may exfoliate pieces of second abradable material 320 such that a distance between second abradable material 320 and abrasive coating 212 remains substantially small, such as within 0.5 inches (1.27 cm), forming an area of low clearance between abrasive coating 212 of first rotor blade 200 and second abradable material 320 of BOAS 208.

Vane 202 may be coupled to frame 214 via outer diameter platform 206. In various embodiments, outer diameter platform 206 may be integral to vane 202 or may be a separate component from and coupled to vane 202. However, in various embodiments, outer diameter platform 206 is not permanently coupled to BOAS 208. In that regard, it is also desirable to prevent air from leaking radially between BOAS 208 and outer diameter platform 206, as this leakage can expose frame 214 to relatively hot fluid.

Traditional high pressure turbines may include a sheet metal gasket bellows seal, or "W seal," seal extending axially between a blade outer air seal and an outer diameter platform. When the gas turbine engine is relatively new, these "W seals" prevent or greatly reduce leakage between the BOAS and the outer diameter platform. However, in response to the gas turbine engine operating, the outer diameter platform may move relative to the BOAS in response to thermally driven deformations and pressure loads. After repeated movement of the outer diameter platform relative to the BOAS, compression and decompression of the "W seals" can result in the quality of the seals degrading.

With reference directed to FIG. 3, high pressure turbine 54 may include a "W seal" 308 extending axially from an aft face 316 of BOAS 208 to a forward face 318 of outer diameter platform 206. However, in addition to the "W seal" 308, a flow restriction 324 (i.e., a feature that reduces an amount of flow between two or more surfaces) is also formed between BOAS 208 and outer diameter platform 206. Because leakage air may flow radially in between BOAS 208 and outer diameter platform 206, flow restriction 324 may be positioned downstream from "W seal" 308. In situations where pressure variations exist in the circumferential direction (i.e., along the C axis), hot gas air may mix in the chamber inboard of "W seal" 308. Flow restriction 324 reduces the potential exposure of "W seal" 308 to hot gas temperatures.

In order to facilitate flow restriction 324, BOAS 208 may include an axial member 310 extending axially away from a main body 322 of BOAS 208. As shown in FIG. 3, axial member 310 is extending axially aft. However, and with reference to FIG. 2, a BOAS 216 positioned radially outward from second rotor blade 204 may have an axial member extending axially forward for forming a seal with outer diameter platform 206.

Returning to FIG. 3, axial member 310 may include a first radial face 312 facing radially inward. Similarly, outer diameter platform 206 may include a second radial face 314 facing radially outward. A first abradable material 302 may be coupled to first radial face 312 and an abrasive material 300 may be coupled to second radial face 314. In response to contact between BOAS 208 and outer diameter platform 206, portions of first abradable material 302 become exfoliated in response to contact with abrasive material 300. In various embodiments, first abradable material 302 and abrasive material 300 may be designed such that at least 75% of total material loss resulting from contact between first abradable material 302 and abrasive material 300 is due to exfoliation of first abradable material 302.

With reference now to FIGS. 2 and 3, in various embodiments, abrasive material 300 and/or abrasive coating 212 may comprise a cubic boron nitride or another suitable material. Similarly, first abradable material 302 may or may not comprise the same material as second abradable material 320.

During standard operation of high pressure turbine 54, in response to receiving a flow of fluid, vane 202 may move relative to frame 214, thus causing outer diameter platform 206 to move relative to BOAS 208. In various embodiments, this may cause outer diameter platform 206 to move axially, radially, and/or circumferentially relative to BOAS 208. In various embodiments, movement of outer diameter platform 206 relative to BOAS 208 may be greater in the axial direction than the circumferential direction or the radial direction. Application of abrasive material 300 and first abradable material 302 along the predominant direction of movement allows the abrasive material 300 to wear into first abradable material 302 and create flow restriction 324 of relatively small size in the radial direction. In order to ensure flow restriction 324 is present under standard engine operating conditions, first abradable material 302 and abrasive material 300 may be axially aligned for a distance 326 in the axial direction. In various embodiments, distance 326 may be great enough such that in response to relative movement of outer diameter platform 206 during standard operating conditions of the gas turbine engine 20 of FIG. 1, at least a portion of first abradable material 302 and abrasive material 300 remain aligned, having an overlap in the axial direction. For example, if the maximum axial movement and tolerances allow for 0.050 inches (1.27 mm) of relative position between 206 and 310, then distance 326 must exceed 0.050 inches to increase the likelihood that flow restriction 324 will continue to restrict the flow under normal operating parameters. Standard operating conditions include engine and aircraft speeds, accelerations, weather conditions, and any other conditions typically experienced by the particular gas turbine engine. For example, gas turbine engines of a military fighter jet may experience greater speeds and accelerations than gas turbine engines of a passenger aircraft.

After initial construction of high pressure turbine 54, a distance 304 between first abradable material 302 and abrasive material 300 may be 0 inches (0 centimeters) or about 0 inches, such as 0 inches+/−0.05 inches (1.27 mm). In response to movement of outer diameter platform 206 relative to BOAS 208, abrasive material 300 may contact first abradable material 302, causing portions of first abradable material 302 to be exfoliated from axial member 310. In response to this exfoliation, distance 304 between first abradable material 302 and abrasive material 300 may remain at substantially 0 inches. Accordingly, in response to movement of outer diameter platform 206 relative to BOAS 208, flow restriction 324 remains sealed and prevents or reduces the impact of degradation of "W seal" 308 and reduces the amount of hot gas "W seal" 308 is exposed to.

Figure 4:
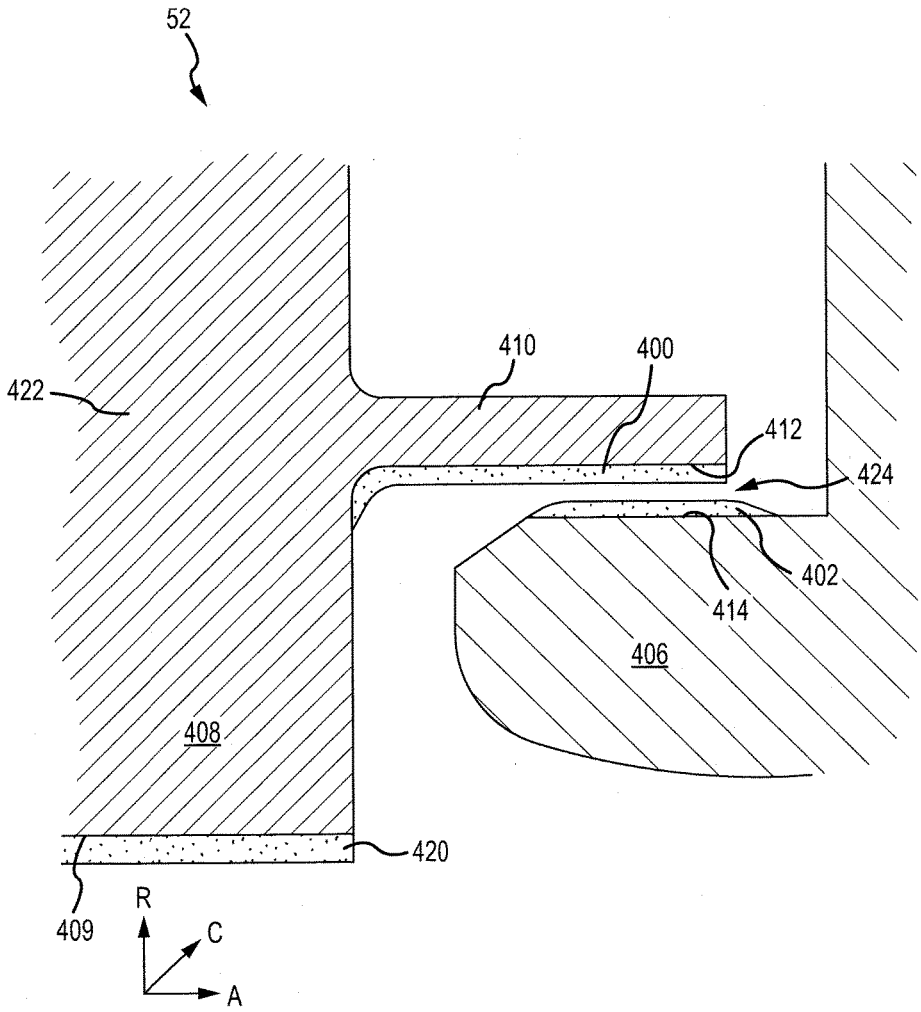
FIG. 4 is an enlarged view of a portion of a high pressure compressor section of the gas turbine engine of FIG. 1, in accordance with various embodiments.

With reference now to FIG. 4, a portion of high pressure compressor 52 is shown. High pressure compressor 52 includes rotors and stators with a blade outer air seal (BOAS) 408 positioned radially outward from a rotor and having a second abradable material 420 on a mating face 409 of BOAS 408. BOAS 408 may similarly include an axial member 410 extending axially from a main body 422. Axial member 410 may have a first radial face 412 that is coupled to an abrasive material 400. BOAS 408 may be positioned adjacent an outer diameter platform 406 of a vane. Outer diameter platform 406 may have a second radial face 414 radially inward from and at least partially facing first radial face 412 of axial member 410. Second radial face 414 may include an abradable material 402 configured to form a seal 424 with abrasive material 400. In that regard, a seal such as seal 424 may be used in any section of compressor section 24 and/or turbine section 28. Similarly, a BOAS may be coupled to an abradable material or an abrasive material and the platform may be coupled to the other of the abradable material or the abrasive material.

With reference to FIG. 3, BOAS 208 and outer diameter platform 206 are static structures, meaning that they do not move relative to frame 214. In various embodiments, a flow restriction such as flow restriction 324 may be used between any two static structures of a gas turbine engine. In that regard, a first static component may refer to BOAS 208 or another static component, and a second static component may refer to outer diameter platform 206 or another static component.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the invention is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A first static component for use in a gas turbine engine having an axis of rotation, the first static component comprising:

a main body a mating face configured to be positioned radially outward from and face a rotor blade;

a second abradable material coupled to the mating face and configured to form a seal with the rotor blade; and an axial member extending aft from the main body, having a first radial face configured to face a second radial face of a second static component of the gas turbine engine, and having a first abradable material coupled to the first radial face and having a same composition as the second abradable material.

2. The first static component of claim 1, wherein the first abradable material is configured to form a flow restriction with an abrasive material coupled to the second radial face of the second static component.

3. The first static component of claim 2, wherein the first abradable material is configured to be axially aligned with the abrasive material for a distance that is greater than or equal to 0.050 inches.

4. The first static component of claim 2, wherein the flow restriction is configured to supplement a sheet metal gasket bellows seal positioned upstream from the flow restriction.

5. The first static component of claim 1, wherein the first static component is a blade outer air seal and the second static component is an outer diameter platform.

6. The first static component of claim 1, wherein the first radial face is positioned radially outward from and at least partially faces the second radial face.

7. A system for reducing leakage air in a gas turbine engine having an axis of rotation, the system comprising:

a rotor blade;

a blade outer air seal having:

a main body, a mating face positioned radially outward from the rotor blade, a second abradable material coupled to the mating face and configured to form a seal with the rotor blade, and an axial member extending away from the main body, the axial member having a first radial face and one of a first abradable material coupled to the first radial face or an abrasive material coupled to the first radial face; and an outer diameter platform having a second radial face at least partially facing the first radial face and the other of the first abradable material or the abrasive material coupled to the second radial face such that the first abradable material and the abrasive material form a flow restriction, wherein the first abradable material has a same composition as the second abradable material.

8. The system of claim 7, further comprising a sheet metal gasket bellows seal positioned downstream from the flow restriction.

9. The system of claim 7, wherein the abrasive material includes cubic boron nitride.

10. The system of claim 7, wherein the first radial face of the blade outer air seal is positioned radially outward from and at least partially faces the second radial face of the outer diameter platform.

11. The system of claim 7, wherein the system is implemented in a high pressure turbine section of the gas turbine engine.

12. The system of claim 7, wherein the system is implemented in a high pressure compressor section of the gas turbine engine.

13. A gas turbine engine, comprising:

a compressor section;

a combustor section; and a turbine section;

wherein at least one of the compressor section or the turbine section include:

a rotor blade;

a stator;

a blade outer air seal positioned radially outward from the rotor blade and having:

a main body, a mating face positioned radially outward from the rotor blade, a second abradable material coupled to the mating face and configured to form a seal with the rotor blade, and an axial member extending away from the main body, the axial member having a first radial face and a first abradable material coupled to the first radial face and having a same composition as the second abradable material; and an outer diameter platform positioned radially outward from the stator and having a second radial face at least partially facing the first radial face and an abrasive material coupled to the second radial face such that the first abradable material and the abrasive material form a flow restriction.

14. The gas turbine engine of claim 13, further comprising a sheet metal gasket bellows seal positioned upstream from the flow restriction.

15. The gas turbine engine of claim 13, wherein the first radial face is positioned radially outward from and at least partially faces the second radial face.

16. The gas turbine engine of claim 13, wherein the first abradable material is configured to be axially aligned with the abrasive material for a distance that is greater than or equal to 0.050 inches.

* * * * *